US006578820B1

(12) United States Patent
Turman

(10) Patent No.: US 6,578,820 B1
(45) Date of Patent: Jun. 17, 2003

(54) SPRING LOADED NAIL REMOVER

(75) Inventor: William F. Turman, 20801 So. Woodward Rd. #43, Manteca, CA (US) 95337

(73) Assignee: William F Turman, Holt, CA (US)

( * ) Notice: Subject to any disclaimer, the term of this patent is extended or adjusted under 35 U.S.C. 154(b) by 0 days.

(21) Appl. No.: 09/609,511

(22) Filed: Jul. 3, 2000

(51) Int. Cl.[7] ..... B25C 11/00
(52) U.S. Cl. ..... 254/20; 254/20
(58) Field of Search ..... 254/18, 29, 25; 29/254

(56) References Cited

U.S. PATENT DOCUMENTS 577,959 A * 3/1897 Humphreys ..... 254/18
968,688 A * 8/1910 Redmond ..... 254/18
1,141,741 A * 6/1915 Wiseman ..... 254/18
2,094,459 A * 9/1937 Lipson ..... 254/18
2,452,457 A * 10/1948 Gray et al. ..... 254/18
2,533,112 A * 12/1950 Hayden ..... 254/18
4,007,913 A * 2/1977 Aldrich ..... 254/18
5,141,205 A 8/1992 Iwai et al. ..... 254/18

* cited by examiner

*Primary Examiner*—Lee Wilson

(57) ABSTRACT

A nail remover device comprising a cylinder over a slidable piston. A compression spring to retract the piston inside the cylinder after manual activation. An accessing device for, positioning nail for removal. Mountable vertically or horizontally on any length 2×4 lumber depending on nail height. Indented piston head for receiving nail before piston is activated.

2 Claims, 5 Drawing Sheets

SPRING LOADED NAIL REMOVER

CROSS-REFERENCED TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND—FIELD OF INVENTION

In the construction of commercial and residential structures with plywood or siding on walls and plywood on the roof. It is a common occurrence for nails that were intended to secure these materials to wood members to miss their intended target.

Depending on the size of the structure, these nails can occur at any height through roof plywood as well as in tall walls.

Often these nails are at precarious angles with little or no room for conventional tools to access them.

BRIEF SUMMARY OF THE INVENTION

The spring loaded nail remover has the capability of hooking those nails which are angled steeply or so close to a wood member that a gap needs to be created in order for the spring loaded nail remover to engulf the nail in its cylinder.

The spring loaded nail remover then manually punches out the nail allowing for final extraction from the opposing side of the plywood or siding.

The spring loaded nail remover can be mounted on any length 2×4 (depending on height of the nail) mounted vertically for nails through the roof plywood or horizontally for nail through wall plywood or siding.

REFERENCE NUMERALS IN DRAWING

Figure 1:
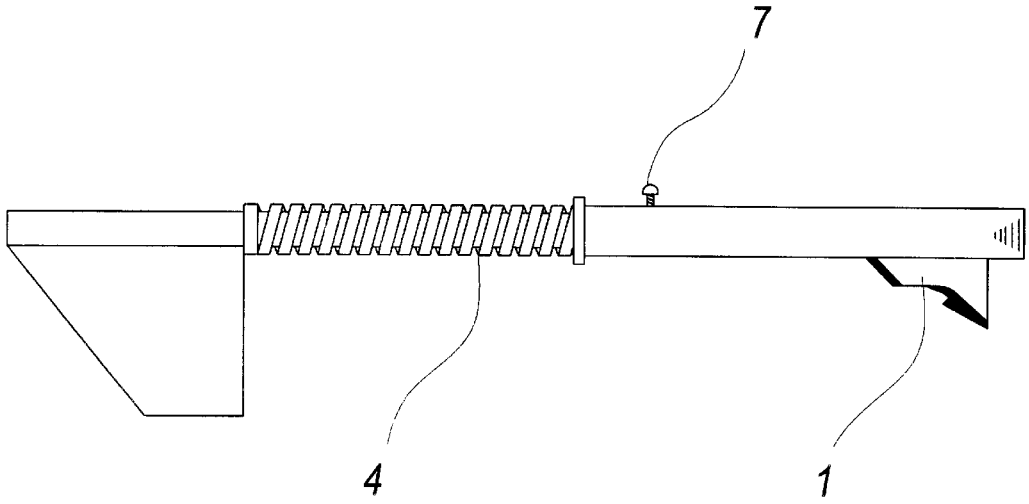
FIG. 1 the spring loaded nail remover as viewed from the left side.

1. gapping hook
2. cylinder
3. piston
4. utility compression spring
5. mounting bracket

6. winged screws
7. retainer pin
8. cylinder slot
9. beveled cylinder tip
10. coned piston head
11. weld
12. 2×4 lumber
13. wood member
14. wood surface
16. nail

DETAILED DESCRIPTION OF THE INVENTION

Description FIGS. 1, 2, 3 and 4

FIG. 1, the spring loaded nail remover being 14 inches in total length. With its novel features the utility compression spring 4, retainer pin 7 and gapping hook 1.

Figure 2:
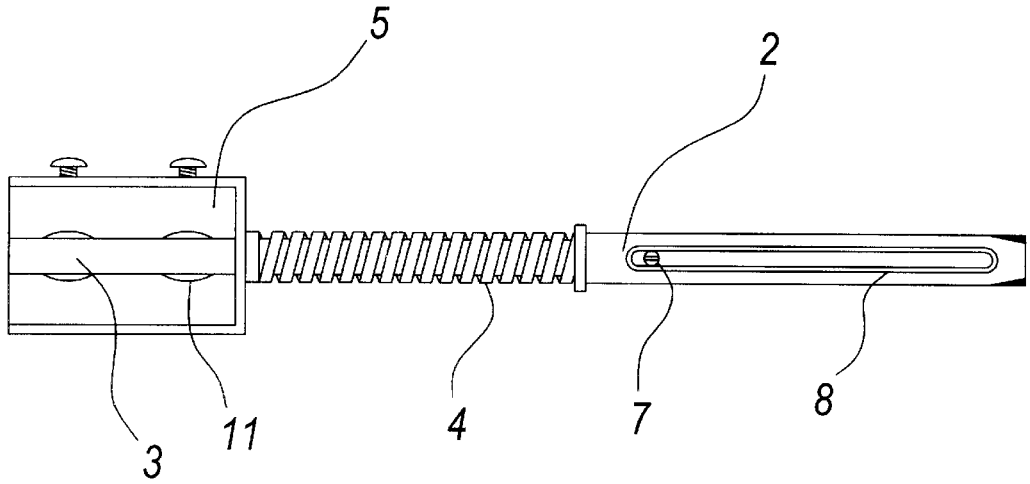
FIG. 2 the spring loaded nail remover as viewed from the top.
Figure 3:
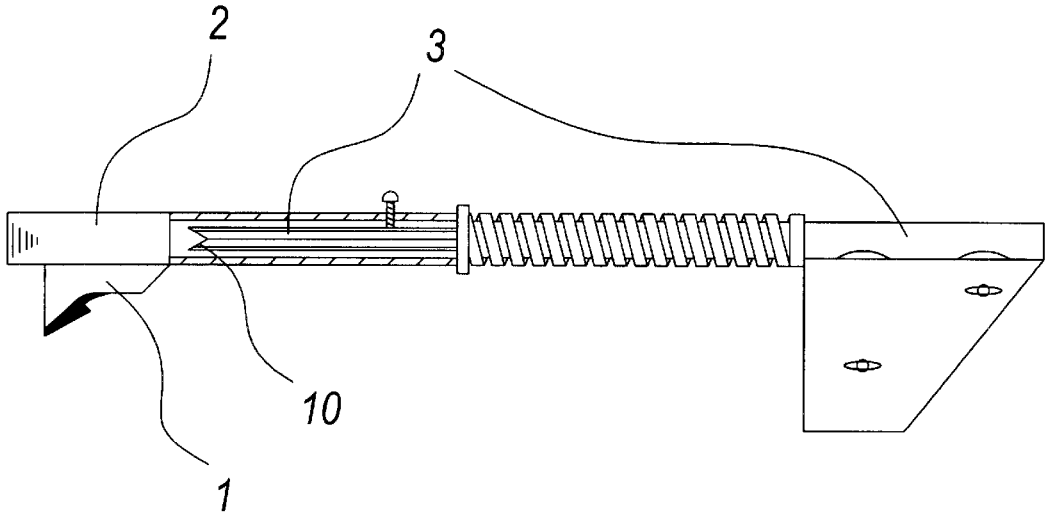
FIG. 3 the spring loaded nail remover as viewed from the right with a hatched view.

FIGS. 2, 3 shows a steel piston is welded 11 cantilevered, on the mounting bracket 5. The utility compression spring 4, inserts over the steel piston 3.

FIG. 3, shows the cylinder 2, inserted over the piston 3. Drilled into the end of the piston a cone shaped indentation 10.

Figure 7:
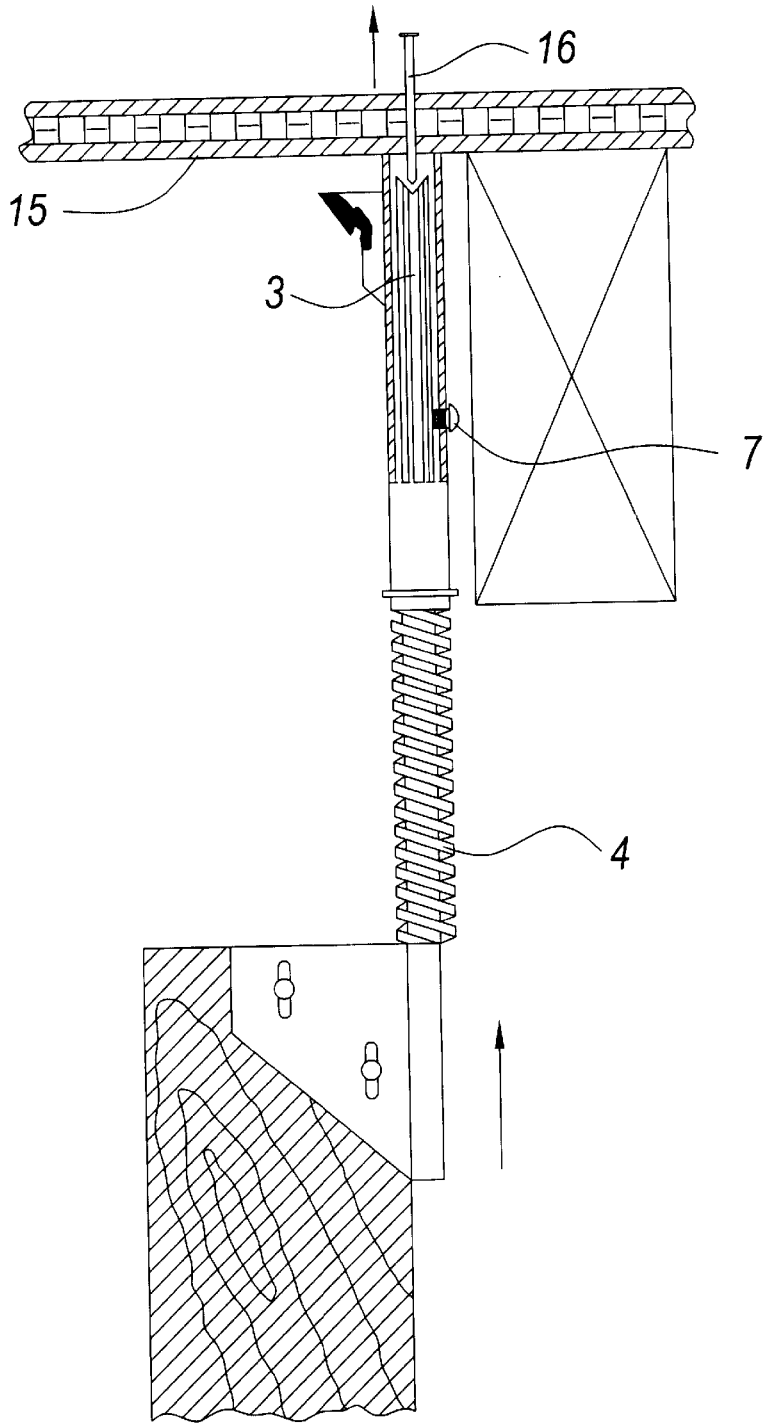
FIG. 7 shows the spring loaded nail remover "punching out" the nail with a hatched view.

FIGS. 2, 7 shows the retaining pin inserted into the piston through a slot 8, cut in the metal cylinder 2, thus securing the spring 4.

Figure 4:
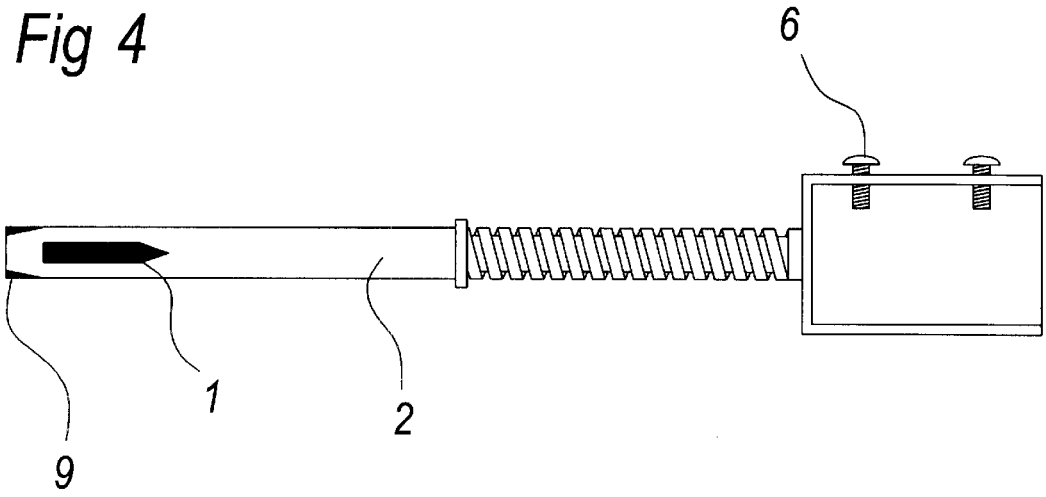
FIG. 4 the spring loaded nail remover as viewed from the bottom.

FIG. 4, a gapping hook shaped and beveled 1, (FIG. 3) welded on the metal cylinder 2. Winged screws are threaded 6, into the mounting bracket to secure the spring loaded nail remover to a 2×4 any length board. A beveled edge 9, is ground out of the cylinder end 2, to ease access to nails with zero clearance between a nail and wood member.

Operation

Figure 5:
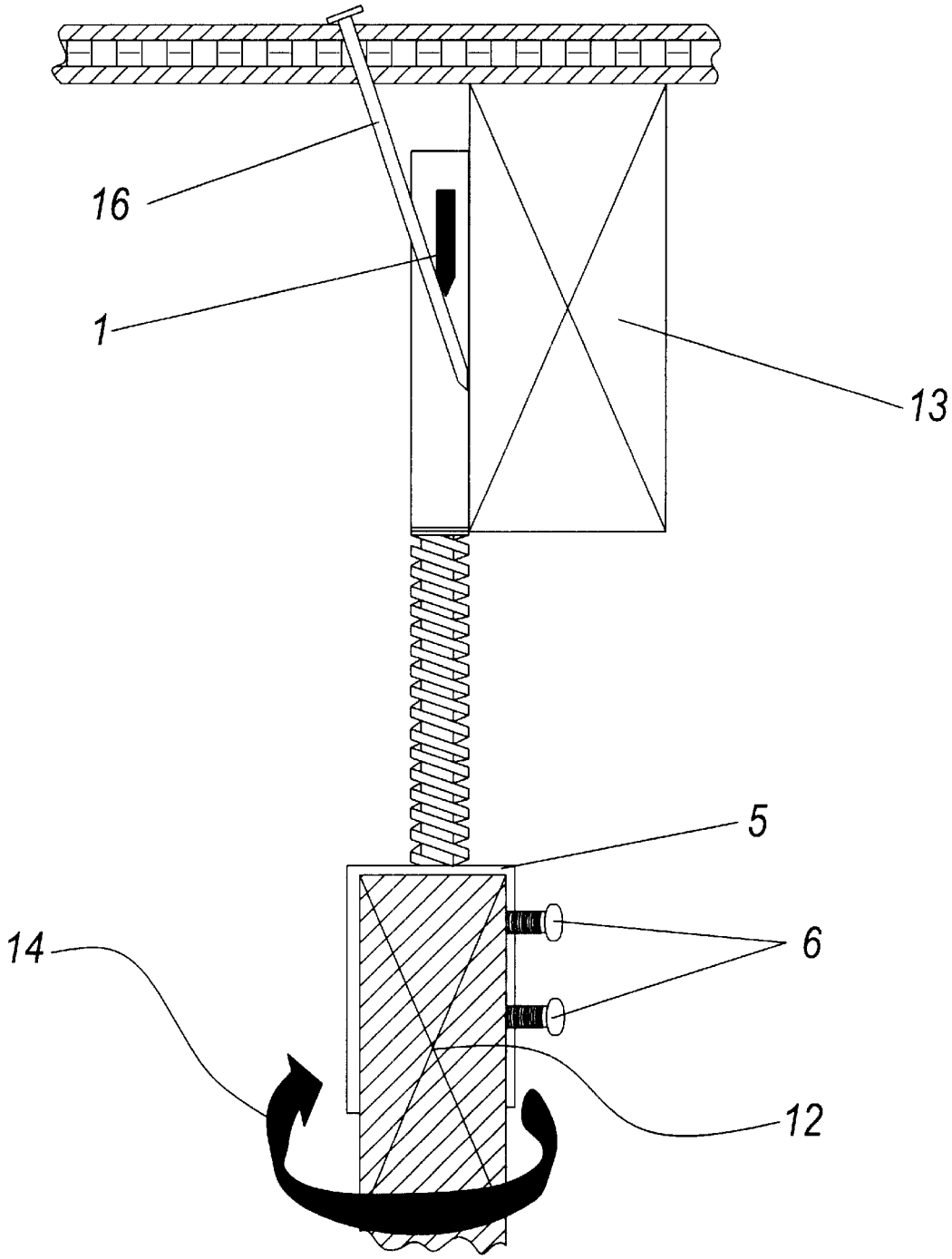
FIG. 5 depicts the spring loaded nail removers ability to make the nail accessible.

FIG. 5, mounted on the 2×4 lumber 12, by means of the mounting bracket 5 with a longitudinal channel and winged screws 6, the gapping hook 1, can be maneuvered into position between the nail 16 and the wood member 13 or elongated member. Then by twisting the spring loaded nail remover 14, the nail is accessible 16 (FIG. 6).

Figure 6:
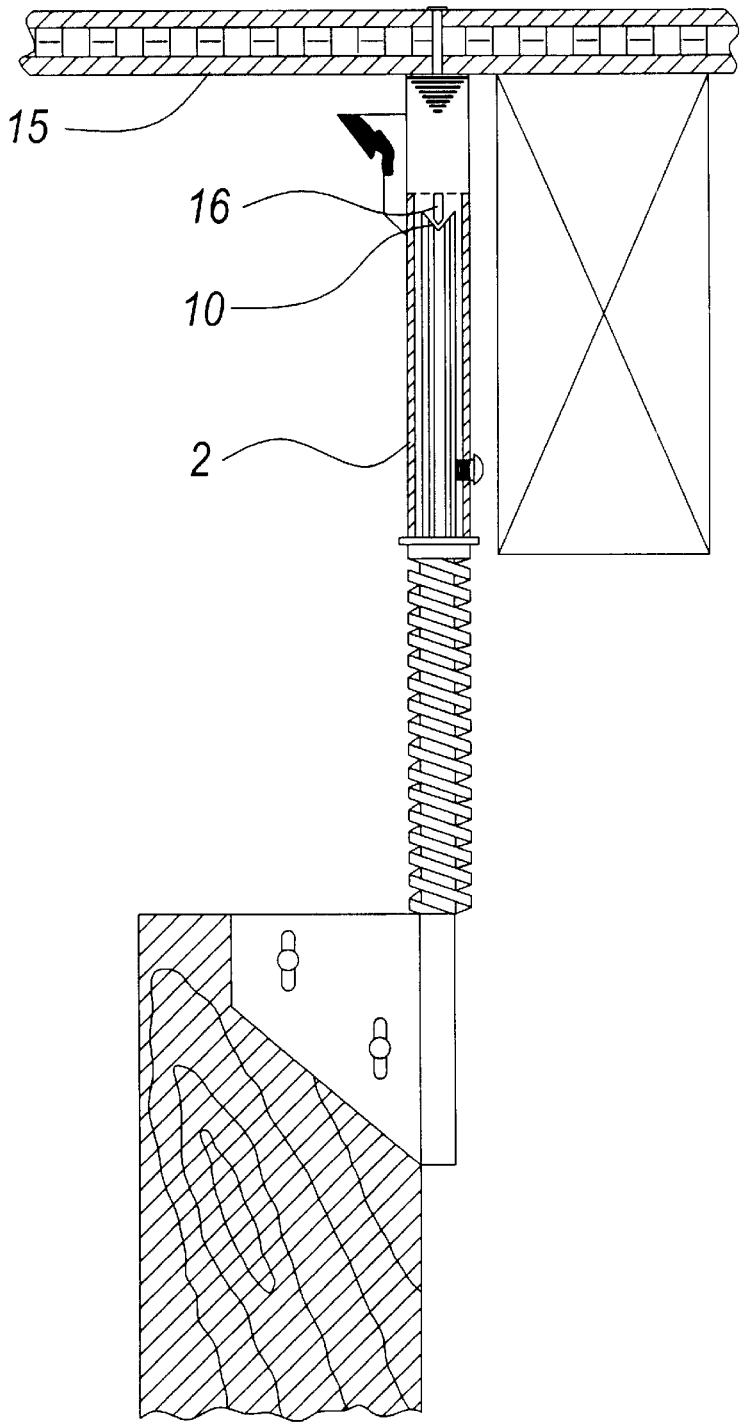
FIG. 6 shows the spring loaded nail remover engulfing the nail with a hatched view.

FIG. 6, insert the cylinder 2, over the nail 16, until it meets the surface 15. The nail inserts into the cone shaped piston end 10.

FIG. 7, manually compress the spring 4, the retaining pin 7, slides up the slot in the cylinder 8, (FIG. 2) until the piston 3, meets the surface 15, forcing the nail upwards where it awaits final extraction 16.

What is claimed is:

1. A nail extracting apparatus comprising:

a mounting bracket with a longitudinal channel which is a means for horizontal and vertical attachment to an elongated member, and a cantilevered piston attached atop said longitudinal channel of said mounting bracket, and a cone shaped indentation in a free end of said cantilevered piston end, a open ended cylinder having with a longitudinal slot with ends; means for sliding said cylinder in a longitudinal direction an extended and between a retracted position at which said cone shaped end of said piston terminates at one of the ends of said slot;

a compression spring disposed between said mounting bracket and said cylinder to, and a hook means.

2. The nail extracting apparatus of claim 1, where in said mounting bracket is removable attached to said elongated member.

* * * * *